United States Patent [19]

Hopkins, Jr.

[11] Patent Number: 4,540,173

[45] Date of Patent: Sep. 10, 1985

[54] BODY ATTACHED ELASTIC TYPE EXERCISING DEVICE

[76] Inventor: David E. Hopkins, Jr., 1045 Catalina Dr. #12 (P.O. Box 2312), Livermore, Calif. 94550

[21] Appl. No.: 560,372

[22] Filed: Dec. 12, 1983

[51] Int. Cl.[3] ..... A63B 21/02

[52] U.S. Cl. ..... 272/139; 272/143

[58] Field of Search ..... 272/119, 126, 139, 142, 272/DIG. 9

[56] References Cited

U.S. PATENT DOCUMENTS

| | | | |
|---|---|---|---|
| 866,495 | 9/1907 | Marks | 272/139 |
| 1,432,013 | 10/1922 | Blake | 272/139 |
| 1,506,631 | 8/1924 | Grover | 272/139 |
| 2,035,010 | 3/1936 | Rawlings | 272/142 X |
| 2,498,006 | 2/1950 | Ridill | 272/143 X |
| 3,138,377 | 6/1964 | Stewart | 272/126 X |
| 3,529,820 | 9/1970 | Templeton | 272/137 |
| 4,026,549 | 5/1977 | Gunn | 272/137 X |
| 4,040,620 | 8/1977 | Friedman | 272/137 |
| 4,059,265 | 11/1977 | Wieder et al. | 272/137 |
| 4,071,241 | 1/1978 | Garcia | 272/119 X |
| 4,090,706 | 5/1978 | Reda | 272/137 |
| 4,441,707 | 4/1984 | Bosch | 272/119 |

FOREIGN PATENT DOCUMENTS

| | | | |
|---|---|---|---|
| 2245272 | 3/1974 | Fed. Rep. of Germany | 272/143 |
| 9327 | 11/1894 | Switzerland | 272/137 |
| 20463 | of 1907 | United Kingdom | 272/139 |
| 451516 | 8/1936 | United Kingdom | 272/137 |

*Primary Examiner*—Richard J. Apley
*Assistant Examiner*—William R. Browne

[57] ABSTRACT

A portable elastic exercising device which may be worn by the user to tone or firm up the wrist, arm and shoulder muscles while exercising not only in the conventional positions of standing, sitting, or lying, but more specifically, since the device is completely independent of the need to be anchored to a fixed object, it thereby permits the user to exercise while walking, running, or jogging, and has a single length of elastic cord that is twice passed through a flexible sheath to encompass the user's waist and whose two ends are also enclosed inflexible sheaths to form handles. Handle loops are maintained by covered steel wire ties or other fasteners.

8 Claims, 6 Drawing Figures

BODY ATTACHED ELASTIC TYPE EXERCISING DEVICE

FIELD OF THE INVENTION

This invention relates to physical conditioning devices, and particularly to a portable device that is worn or carried around a user's midsection and permits the user to tone or firm up the upper body muscles of the arms, wrists and shoulders, not only in the conventional exercising positions of standing, sitting, or lying, but more specifically permitting the user to exercise while walking, running or jogging.

BACKGROUND OF THE INVENTION

Portable, inexpensive elastic exercising devices that can be used for jogging are generally known in the art. One such device is disclosed in U.S. Pat. No. 4,073,490 to Feather. Unlike the present invention, the Feather device must be attached or anchored to a fixed object and the user must run or jog in place.

SUMMARY OF THE INVENTION

With the increased emphasis on personal physical conditioning, a need has existed for a portable elastic exercising device that can be safely worn by the user while exercising in various positions, but also while running, walking or jogging. It is an object of this invention to provide such an exercise device.

Another object of the invention is to provide an elastic exercising device which can be used for firming and toning the wrist, arm and shoulder muscles.

A further object of the invention is to provide a simple and inexpensive exercising device for people of various age groups.

A still further object of the invention is to provide a completely portable exercising device that does not need to be attached or anchored to a fixed object.

A still further object of the invention is to provide an exercise device that is self-adjusting and will snugly fit the user's waist to prevent slippage.

It is a further object of this invention to provide an exercise device that insulates the user against skin abrasion and clothing damage.

It is a further object of this invention to provide an exercise device that can be altered to fit the user's waist and hand size.

The apparatus of the present invention provides a portable exercising device that is worn by the user for toning the wrist, arm, and shoulder muscles, and is completely independent of the need to be secured to a fixed object in order to be used. The apparatus can be used not only in the conventional exercising positions of standing, sitting, and lying, but it can also be manipulated while walking, jogging, or in any other position that allows the user to freely pull the handles of the device away from the body to apply tension to the elastic material. The resultant tension, when repetitively applied to the elastic material, firms and tones the respective muscle sets used. Various lengths and diameters of elastic material may be used so that the device will be suitable for use by a variety of users of all ages and physical stamina. This is achieved by a portable exercising device that is of simple construction and relatively low cost.

To achieve the foregoing and other objects, and in accordance with the purposes of the present invention, as embodied and broadly described herein, the body attached portable exercising device is an apparatus comprised of an elastic material that is twice passed through a flexible sheath that partially encircles the user's waist to provide protection against skin abrasion and clothing damage. First and second flexible heat shields are slipped over either end of the body flexible sheath to provide the user protection against the heat generated by the friction of the elastic material against the body sheath. First and second bushing means are inserted in each end of the body flexible sheath to prevent the sheath from being frayed by the rubbing action of the elastic material. First and second handle means comprised of flexible sheaths that enclose the elastic material are provided as padding for the users hands. First and second fastener means are provided to secure and maintain the handle loops.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated and form a part of the specification, illustrate an embodiment of the invention and, together with the description, serve to explain the principles of the invention.

DETAILED DESCRIPTION OF THE INVENTION

The present invention is an exercise apparatus adapted to be worn around a user's waist to exercise while standing, sitting, walking or lying. More particularly, the apparatus is suitable for use by joggers while they run. In this instance, it characteristically exercises the upper body muscles of the arms, wrists and shoulders.

Figure 1:
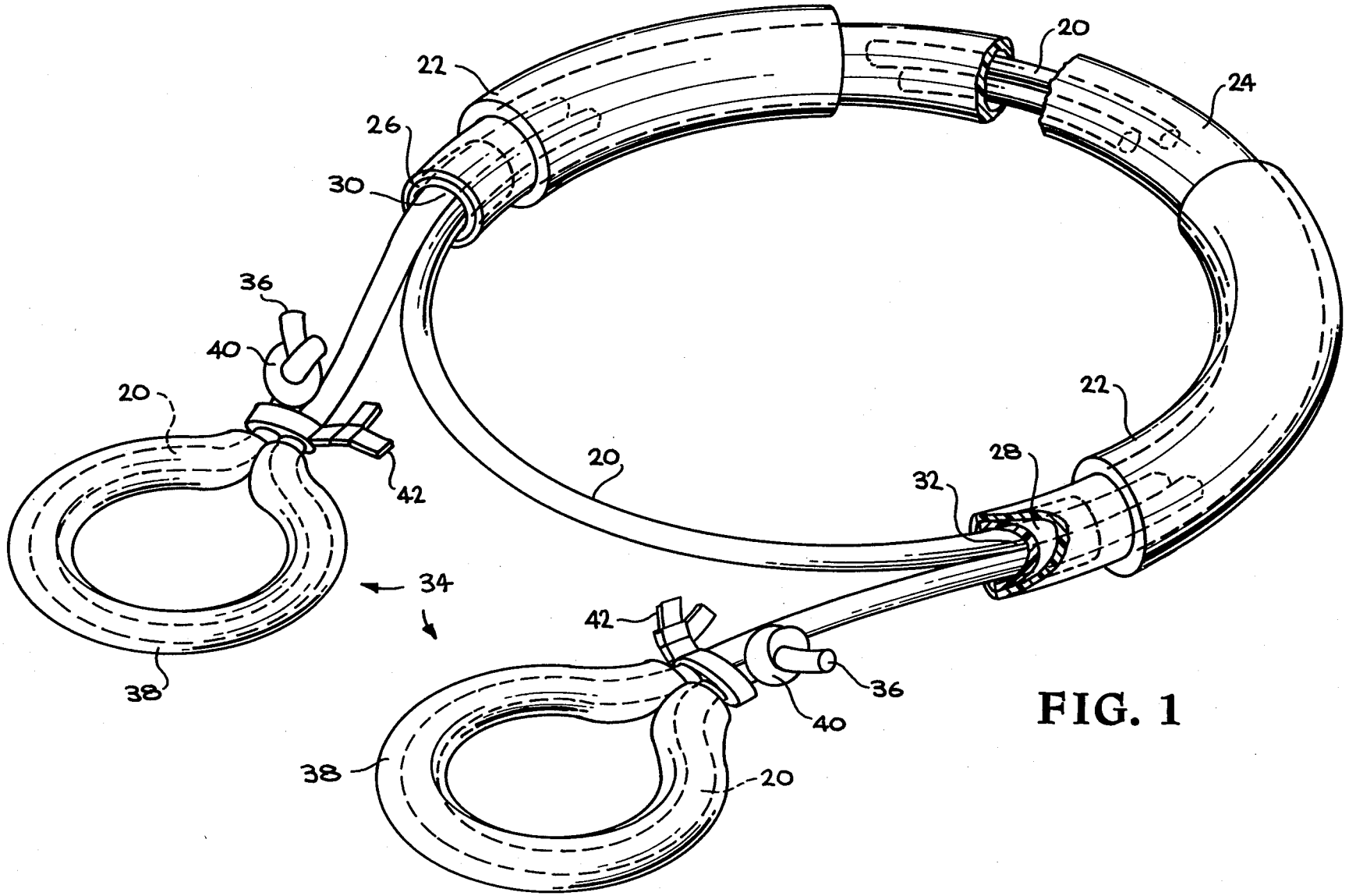
FIG. 1 is a perspective view showing the principles of the present invention.
Figure 2B:
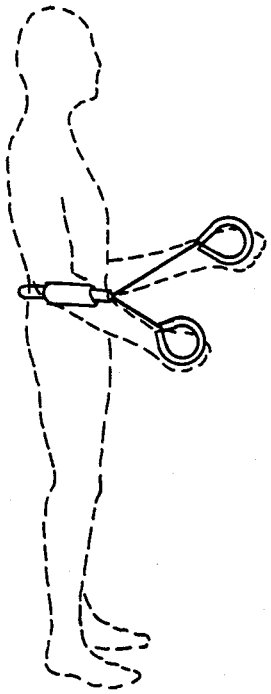
FIG. 2*b* is a plan view showing the elastic exerciser of the present invention being manipulated by the user in the standing position.
Figure 2E:
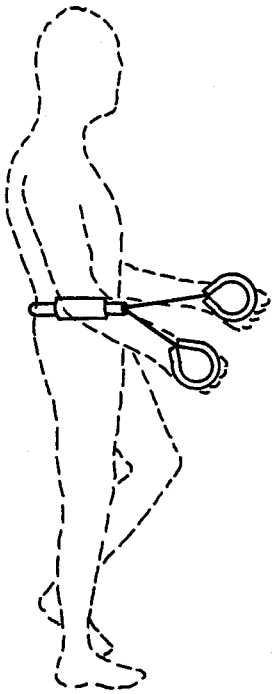
FIG. 2*e* is a plan view showing the elastic exerciser of the present invention being manipulated by the user in the walking position.
Figure 2C:
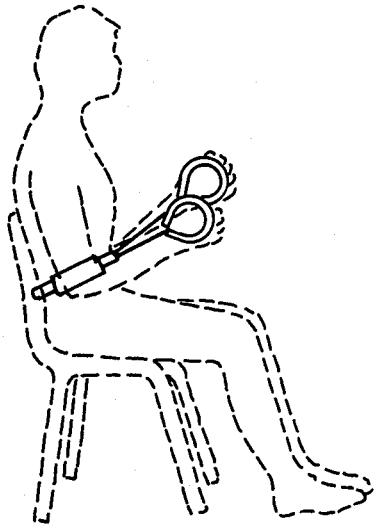
FIG. 2*c* is a plan view showing the elastic exerciser of the present invention being manipulated by the user in the sitting position.
Figure 2A:
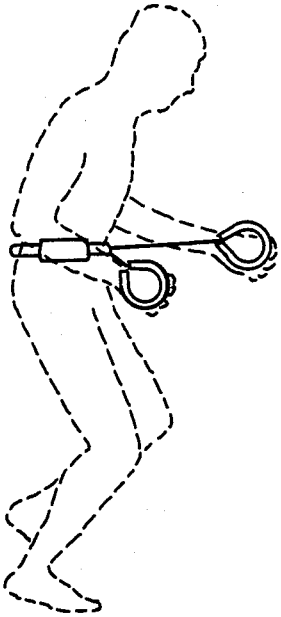
FIG. 2*a* is a plan view showing the elastic exerciser of the present invention being manipulated by the user in the running or jogging position.
Figure 2D:
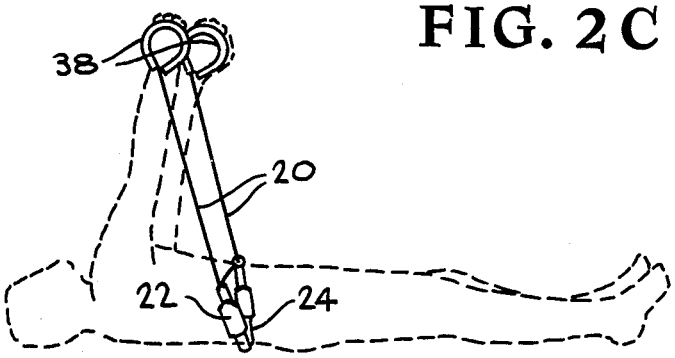
FIG. 2*d* is a plan view showing the elastic exerciser of the present invention being manipulated by the user in the lying position.

Referring now to the perspective view of FIG. 1, one embodiment of the exerciser is shown. As illustrated, an elastic cord 20 is provided which is comprised of a stretchable material having various diameters, lengths, and resistance in order to vary the degrees of resiliency for a variety of users. Cord 20 can be comprised of a plurality of woven nylon covered elastic rubber strands and the like. Flexible heat shields 22 are optionally included and slidably mounted over each end of sheath 24. These shields are comprised of a soft plastic or other flexible substance of sufficient density and length to protect the user against the heat generated by the friction of the elastic cords rubbing against sheathing 24.

Bushings 26 and 28 are inserted in openings 30 and 32 of sheath 24, and in a preferred embodiment, sheath 24 is comprised of a nylon reinforced plastic tubing or other flexible tubing of various diameters or shapes with sufficient inside clearance to easily encompass two widths of unstressed elastic cord 20. Sheath 24 provides protection to the user from pinching, skin abrasion, and possible damage to clothing that may be caused by the rubbing action of cord 20. The elastic cord 20 is passed through the entire length of sheath 24 through opening 30 and bushing 26, then out through bushing 28 and opening 32. To complete the formation of a circle with cord 20 in sheathing 24, cord 20 is reinserted in sheathing 24 at opening 30 and again is passed through the entire length of sheathing 24 and through bushing 28 and out opening 32. A complete circle, comprised of cord 20 and sheathing 24 now exists, and encircles the user's midsection when worn on the person. Two strands of elastic cord 20 are disposed within sheath 24.

A desired amount of cord 20 is left extending out of sheathing 24 at end openings 30 and 32 to form handle loops 34. Handle loops 34 are formed by passing ends 36 of elastic cord 20 through a second sheath 38 which can be comprised of vinyl plastic or other flexible tubing of various diameters or shapes and with sufficient density to provide padding for the formed handle loops 34.

Each end 36 of elastic cord 20 has a tied knot 40 for preventing the ends 36 of cord 20 from slipping out of sheath 38. The ends 36 are secured to elastic cord 20 by means of covered steel wire ties 42 to maintain handle loops 34.

In other embodiments a knot, clip, hog ring, or other fastener can be used in place of ties 42 to maintain handle loops 34.

Reference is now made to FIGS. *2a–2e* which illustrate the device being used in various positions. As a result of this manipulation, the user exercises to some extent the following six primary muscles with the flexion, medial (inward) rotation, and extension movements:

1. Biceps Brachii
2. Anterior Deltoid
3. Pectoralis Major (Clavicular)
4. Brachialis
5. Brachioradialis
6. Triceps Brachii In addition, the following six muscle groups assist the above muscles during this manipulation:

1. Coracobrachialis
2. Posterior Deltoid
3. Sub Scapularis
4. Anconeus
5. Latissimus Dorsi
6. Teres Major Many other possibilities for exercising various muscles also exist. For example, if the user rotates the arm in a palm-up position (supination) the supinator muscle is used. In the palm down position, the pronator teses is used.

The foregoing description of preferred embodiments of the present invention has been presented for purposes of illustration and description. It is not intended to be exhaustive or to limit the invention to the precise form disclosed, and obviously modifications and variations are possible in light of the above teaching. For example the flexible sheath may have an oval configuration, or it may be fluted to help dissipate the heat generated by the friction of the elastic cord. The embodiments were chosen and described in order to best explain the principles of the invention and their practical applications, to thereby enable others skilled in the art to best utilize the invention in various embodiments and with various modifications as are suited to the particular use contemplated. It is intended that the scope of the invention be defined by the claim appended hereto.

I claim:

1. A portable body attached exercising apparatus comprising:

an elongated hollow cylindrical housing having two opposing open ends and configured to partially encircle the user's body;

an overlap cord partially disposed in and extending through said cylindrical housing, said cord being formed of an elastic material and adapted to engaging a person's midsection; and said cord having two ends extending from and each said end of said cord having a loop forming a handgrip.

2. The apparatus according to claim 1, further comprising first and second bushings disposed within said cylindrical housing at each opposing end.

3. The apparatus according to claim 2, wherein each of said bushings is comprised of a polymer.

4. The apparatus according to claim 1, further comprising first and second sleeves disposed in surrounding slidable relationship to said cylindrical housing adjacent said opposing open ends, said sleeves being capable of slidable movement along said cylindrical housing as to minimize frictional heat against a person's midsection generated by the movement of said cord against said housing.

5. The apparatus of claim 4, wherein each of said sleeves is comprised of a flexible vinyl material.

6. The apparatus according to claim 1, further comprising means for selectively adjusting the size of each of said loops of said two ended cord.

7. The apparatus according to claim 1, wherein said cylindrical housing has an oval configuration.

8. The apparatus according to claim 1, wherein said cord is comprised of a flexible vinyl material.

* * * * *